US008069675B2

(12) United States Patent
Radovinsky et al.

(10) Patent No.: US 8,069,675 B2
(45) Date of Patent: Dec. 6, 2011

(54) CRYOGENIC VACUUM BREAK THERMAL COUPLER

(75) Inventors: Alexey L. Radovinsky, Cambridge, MA (US); Alexander Zhukovsky, Brighton, MA (US); Valery Fishman, Framingham, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 1162 days.

(21) Appl. No.: 11/881,990

(22) Filed: Jul. 30, 2007

(65) Prior Publication Data

US 2008/0104968 A1 May 8, 2008

Related U.S. Application Data

(60) Provisional application No. 60/850,565, filed on Oct. 10, 2006.

(51) Int. Cl.
*F25B 9/00* (2006.01)

(52) U.S. Cl. ..... 62/6

(58) Field of Classification Search ..... 62/6, 55.5, 62/268, 383; 417/901; 248/638
See application file for complete search history.

(56) References Cited

U.S. PATENT DOCUMENTS

| | | | | |
|---|---|---|---|---|
| 3,430,455 | A * | 3/1969 | Hogan et al. | 62/383 |
| 3,483,709 | A * | 12/1969 | Sayres et al. | 62/51.1 |
| 4,667,486 | A | 5/1987 | Miller et al. | |
| 4,667,487 | A * | 5/1987 | Miller et al. | 62/51.1 |
| 4,763,483 | A * | 8/1988 | Olsen | 62/55.5 |
| 4,930,318 | A * | 6/1990 | Brzozowski | 62/51.1 |
| 4,986,078 | A | 1/1991 | Laskaris | |
| 5,111,665 | A * | 5/1992 | Ackermann | 62/6 |
| 5,216,889 | A | 6/1993 | Herd et al. | |
| 5,222,366 | A | 6/1993 | Herd et al. | |
| 5,235,818 | A * | 8/1993 | Horikawa et al. | 62/51.1 |
| 5,394,129 | A | 2/1995 | Obasih et al. | |
| 5,430,423 | A * | 7/1995 | Herd et al. | 335/216 |
| 5,522,226 | A * | 6/1996 | Mruzek | 62/51.1 |
| 5,682,751 | A * | 11/1997 | Langhorn et al. | 62/51.1 |
| 5,737,927 | A | 4/1998 | Takahashi et al. | |
| 6,112,530 | A * | 9/2000 | Tench et al. | 62/50.7 |
| 6,144,274 | A * | 11/2000 | Bischke et al. | 335/216 |

(Continued)

FOREIGN PATENT DOCUMENTS

WO WO 2005/116515 12/2005

OTHER PUBLICATIONS

International Search Report and the Written Opinion of the International Searching Authority for PCT/US2007/021381, mailed on Sep. 9, 2008.

U.S. Appl. No. 12/151,149, filed May 2, 2008, entitled Cryogenic Vacuum Break Thermal Coupler With Cross-Axial Actuation, in the names of two of the inventors hereof.

(Continued)

*Primary Examiner* — Frantz Jules
*Assistant Examiner* — Lukas Baldridge
(74) *Attorney, Agent, or Firm* — Steven J. Weissburg

(57) ABSTRACT

A novel thermal coupler apparatus and method to couple a cryocooler or another cooling device to a superconducting magnet or cooled object allows for replacement without a need to break the cryostat vacuum or to warm up the superconducting magnet or other cooled object. A method uses a pneumatic actuator for coupling, and a retractable mechanical actuator for uncoupling. Mechanical closing forces are balanced between the intermediate temperature and low temperature cooling surfaces and do not transfer to the cooled object. The pneumatic actuator provides permanent control under mechanical closing forces in the thermal coupling.

31 Claims, 9 Drawing Sheets

U.S. PATENT DOCUMENTS

| | | | | |
|---|---|---|---|---|
| 6,209,443 | B1 | 4/2001 | Perez | |
| 6,438,966 | B1 | 8/2002 | Sarwinski et al. | |
| 6,438,967 | B1 * | 8/2002 | Sarwinski et al. | 62/6 |
| 7,266,954 | B2 * | 9/2007 | Yamada | 62/115 |
| 2008/0092557 | A1 * | 4/2008 | Mraz et al. | 62/51.1 |
| 2009/0272127 | A1 | 11/2009 | Radovinsky et al. | |

OTHER PUBLICATIONS

International Search Report and the Written Opinion of the International Searching Authority for PCT/US2009/002600, mailed on Jun. 26, 2009.

* cited by examiner

CRYOGENIC VACUUM BREAK THERMAL COUPLER

RELATED DOCUMENTS

The benefit of U.S. Provisional application No. 60/850,565, filed on Oct. 10, 2006, entitled CRYOGENIC VACUUM BREAK PNEUMATIC THERMAL COUPLER, is hereby claimed, and the entire document is hereby incorporated by reference herein.

BACKGROUND

The progress of cryocoolers in the past 20 years has brought the technology to the state where magnet cooling in the absence of liquid cryogens is a more attractive option than with the use of liquid helium for some applications. In addition to cost and convenience, the absence of liquid helium is attractive from the point of safety, as the issues with rapid pressurization of the cryogen and possible release of helium gas to environment surrounding the device can be avoided. Cryogen-liquid-free magnets require fewer external subsystems, fewer services, and thus are also more portable.

Many applications of the cryogen-free technology have been implemented, from magnets to detectors, for applications in outer space as well as on the ground.

The present liquid-free cryocooler technology is very reliable, with present Mean-Time-Between-Failures of about 10000 hours for Gifford-McMahon cryocoolers and 20000 hours for pulse-tube cryocoolers. Although adequate for short-term applications, for long term application means of being able to replace the unit for maintenance are necessary.

Usual thermal insulation for the cooled object and for the cryocooler cold head includes vacuum isolation of the cold surfaces. Apiezon N grease is used in couplings for a better thermal contact and improved thermal conductivity at cryogenic temperatures in vacuum. In demountable (those that need to be disconnected) couplings, indium gaskets are used for the same purpose. Indium gaskets compressed in the coupling with a pressure at which indium flows plastically provide a good thermal contact in the connected couplings, with reliable demountable joints.

For some long-term applications, it is desirable to replace the head of the cryocooler without breaking the cryostat vacuum around the cold object, and sometimes even without warming up the device. The need for removing the cryocooler head, without cooled device warm-up, demands features of both the thermal management system as well as for the vacuum that surrounds the cooled magnet. It is a purpose of an invention hereof for a mechanical and thermal coupler and a method of providing a quick thermal and mechanical connect and disconnect of a cryocooler, which does not require warm-up of the cooled device while replacing a cryocooler, which can be performed quickly without influencing the cooled object vacuum, and which can be conducted without any forces being applied to the object to be cooled, which is generally sensitive thereto. It is also important, where possible, to provide for such quick thermal and mechanical connect and disconnect of a cryocooler without applying any force to any of: the cooling device itself, the walls of the cooling device vacuum or the walls of the cooled object vacuum. For better thermal coupling, the coupler should also provide reliable and controllable contact pressure between the cryocooler cold head and the cooled object thermal stations through the coupler of the demountable thermal joints.

SUMMARY

A more detailed partial summary is provided below, preceding the claims. Coupler systems are described herein to provide for a quick thermal and mechanical connect and disconnect of cryocooler heads. Two vacuums are used. The vacuum that is used in the cryocooler environment is different from that of the cooled object vacuum (cryostat vacuum). Mechanical means apply the required forces to maintain good contact between discrete components, to effectively transfer thermal loads in vacuum. For a two stage cooling device the actuator creates adjustable forces on interfaces between the cryocooler stages and respective thermal stations of the cooled object. Forces at the interfaces are reacted through the actuator in series with the walls separating the cryocooler and cryostat vacuums.

In addition, it is convenient to provide the pressures required for establishing good thermal contact across the interface of the demountable thermal joints in vacuum by means that do not transfer loads to the object to be cooled. Surfaces designed with compressible gaskets for good thermal transfer across the interface may bond, so that breaking the demountable thermal joint is difficult. Means are disclosed to provide the forces required for separation of different elements in the interface.

DETAILED DESCRIPTION

Figure 1A:
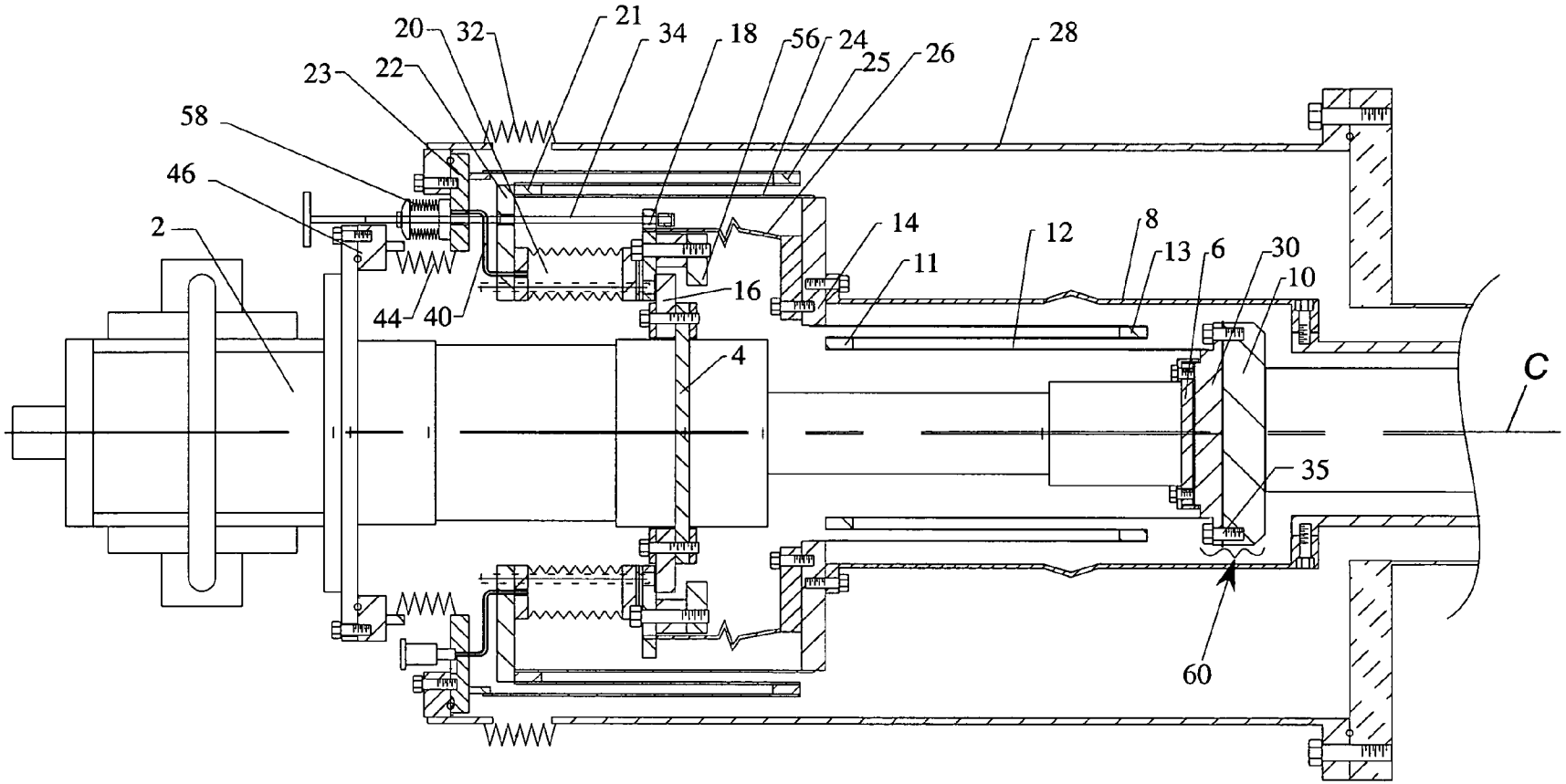
FIG. 1A shows a schematic cross-section view of a partially axially symmetric pneumatically actuated coupler for providing thermal contact between a two-stage cryocooler and corresponding cooled object, with both stages engaged.
Figure 1B:
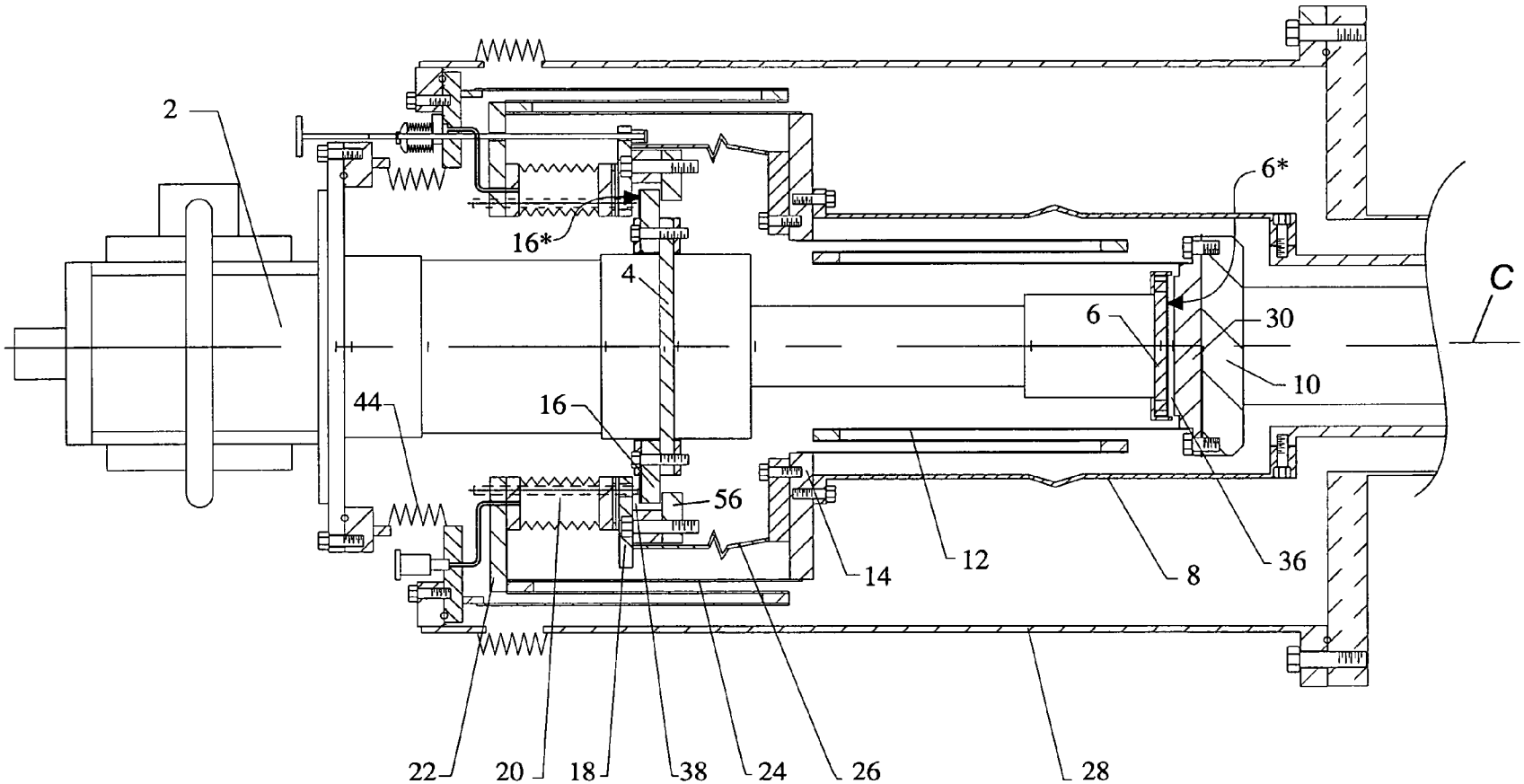
FIG. 1B shows a cross-sectional view of the coupler shown in FIG. 1A, with both stages of the cryocooler disengaged from the cooled object and the intermediate temperature thermal path.

FIGS. 1A and 1B show a coupler system where there are two separate vacuums for a cooled object and for the cryocooler, as well as two thermal paths for the cooled object (cold thermal path) and intermediate temperature thermal path (for the radiation shield, current leads and others).

FIG. 1A is a cross-section through an embodiment of an apparatus invention hereof, showing the cooling device engaged. FIG. 1B is a cross-section through the apparatus, showing the cooling device disengaged. FIG. 1A shows the cryocooler engaged to both the intermediate temperature and cold thermal stations. FIG. 1B shows the cryocooler disengaged from the intermediate temperature and cold thermal stations. (In the industry, typically the warmer temperature station is referred to as the intermediate thermal station (being intermediate between cold and room temperature). As used herein, and in the claims, either the term first, or the term intermediate may be used to identify a thermal station, that is typically not the coldest station. In the claims, typically first is used, whereas in this specification, intermediate is typically used.) The word station is generally used to refer to a component permanently thermally connected with the cold object or its radiation shield. Below, the word stage is generally used to refer to a component of the cooling device.

The object to be cooled and its surrounding cryostat are not shown in FIG. 1A or 1B, because to do so and show both to scale is awkward. Typically, the object to be cooled is significantly larger in both mass and dimensions than the cryocooler. For instance, the mass of a cryocooler could be 10 kg, to cool a magnet of about 1000 kg. The relative physical dimensions would be similarly sized.

The cooled object external vacuum boundary, between the outer environment and the cooled object vacuum includes the cryostat vacuum wall 28, bellows 32 and room temperature flange 23, end other elements not shown. There is an internal boundary between the cooling device vacuum and the cooled object vacuum established by the cryocooler sleeve, including the cold station 30, cold-to-intermediate temperature support tube 12, intermediate temperature flange 14 and intermediate-to-room temperature support tube 24, attached to the room temperature flange 23.

The cooling device vacuum is bounded, on its inside, by the cooling device itself, having first stage 4 and second stage 6, and on its outside some elements that bound, in part, the cold object vacuum, including cold station 30, cold-to-intermediate support tube 12, intermediate temperature flange 14, intermediate-to-room temperature support tube 24, room temperature flange 23, and flexible bellows 44, end vacuum flange 46 and cryocooler head flange 2.

There are two thermal paths. The cold thermal path includes the cryocooler second stage 6 through cold station 30 and cold thermal anchor 10. The cold thermal anchor 10 is in good thermal contact with the cooled object, not shown. The means by which the cooled object is thermally and mechanically connected to the cold anchor are not important, except that the connection is of a type that does not result in any forces being applied to the object to be cooled as a result of establishment of the thermal coupling with the cooling device into the thermal paths, described below. Typically, the cold station 30 and the cold anchor 10 are fixed to each other, essentially permanently, for example, by bolts, or any other suitable mechanism to establish a permanent thermal connection. Thus, they may be considered together as a cold unit 60. In fact, rather than the two separate elements of a cold anchor 10 and a cold station 30 being used, a single unitary cold unit 60 may be used in some circumstances. The term cold unit is used in this specification and the attached claims to mean both the two separate elements of a cold anchor 10 and a cold station 30 associated together, or a single unitary element that performs their functions.

Figure 4A:
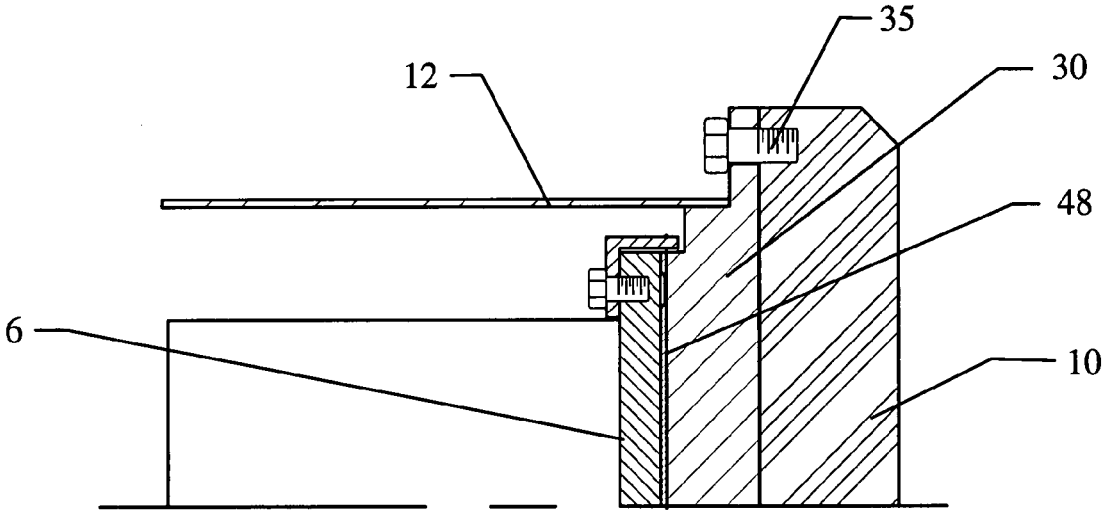
FIG. 4A shows an enlarged view of a portion of the cross-section view of FIG. 1A, showing the cryocooler engaged to the cold thermal path to the cooled object (magnet)
Figure 4B:
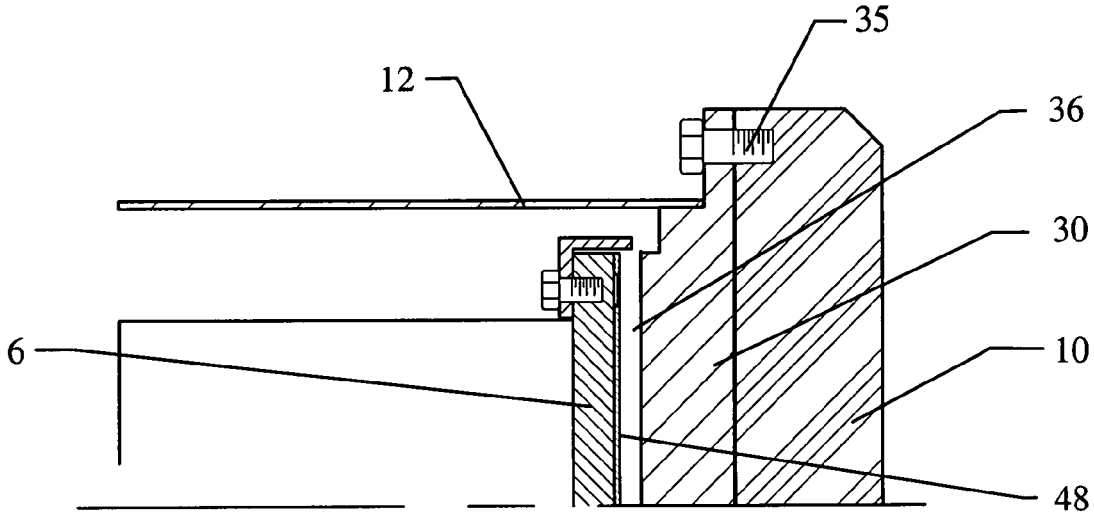
FIG. 4B shows an enlarged view of a portion of the cross-section view of FIG. 1B, with cryocooler disengaged and gap 36 open.
Figure 5A:
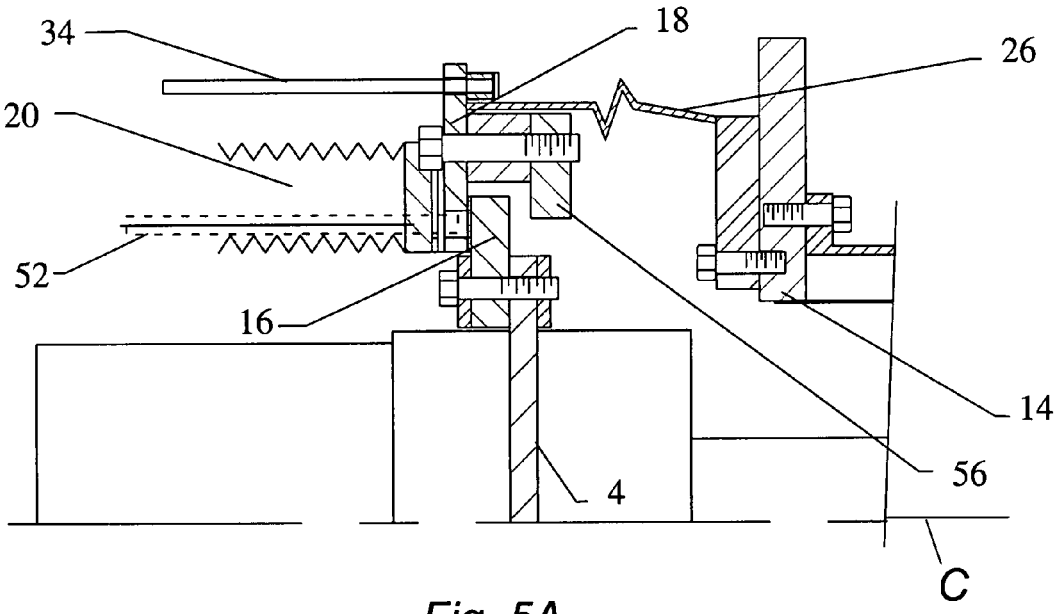
FIG. 5A shows an enlarged view of a portion of the cross-section view of FIG. 1A, showing the intermediate temperature thermal path with cryocooler engaged.
Figure 5B:
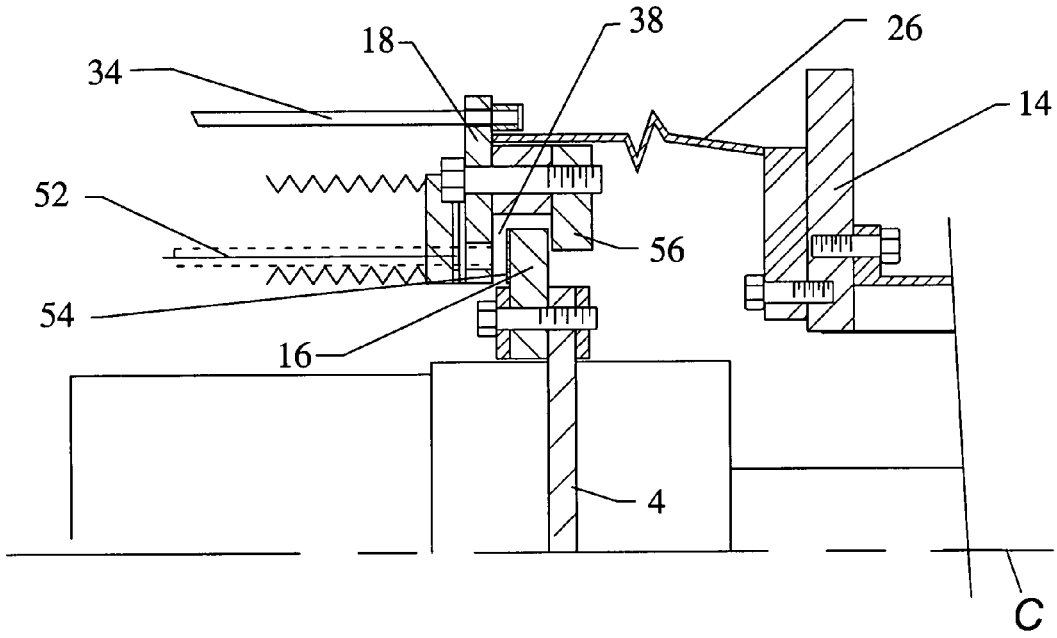
FIG. 5B shows an enlarged view of a portion of the cross-section view of FIG. 1B, with cryocooler disengaged and gap 38 open.

To increase thermal conductance, a pliable layer can be placed between the surfaces in thermal joints. For instance, Apiezon N grease can be used in the coupling for better thermal contact between cold station 30 and cold thermal anchor 10, which is not disturbed during cryocooler removal/installation. Indium gasket 48 is bonded to the surface of the cryocooler cold stage 6 that is in contact with the cold station 30 (see FIGS. 4A and 4B). The cold thermal circuit is broken by retracting the cryocooler and opening a gap 36 between the cryocooler second stage 6 and the cold station 30. During disengagement and removal, indium gasket 48 remains attached to cryocooler second stage 6. (In the industry for two stage cryocoolers, typically, the warmer temperature stage is referred as the first stage, which is used to cool the intermediate temperature thermal station (being intermediate between cold and room temperatures). The second stage refers to the coldest temperature stage of the cryocooler, which is used to cool the cooled object.)

The intermediate temperature thermal path includes the cryocooler first stage 4, cryocooler first stage wing 16, the intermediate temperature station 18, flexible thermal anchor 26, intermediate temperature flange 14, and the intermediate temperature flexible thermal anchor 8, which is in good thermal contact with the intermediate temperature thermal shield. The intermediate temperature thermal shield surrounds the cooled object and serves to intercept the heat to the cold object as well as to the current leads, cold mass supports, and other sources of heat at temperatures between the cooled object and room temperature. The intermediate temperature thermal path is interrupted when the cryocooler is retracted, opening a gap 38 in the intermediate temperature thermal path between the intermediate temperature station 18 and cryocooler first stage wing 16. The indium gasket 54 is attached to the cryocooler first stage wings 16, and is removed with it during cryocooler retraction.

Figure 2:
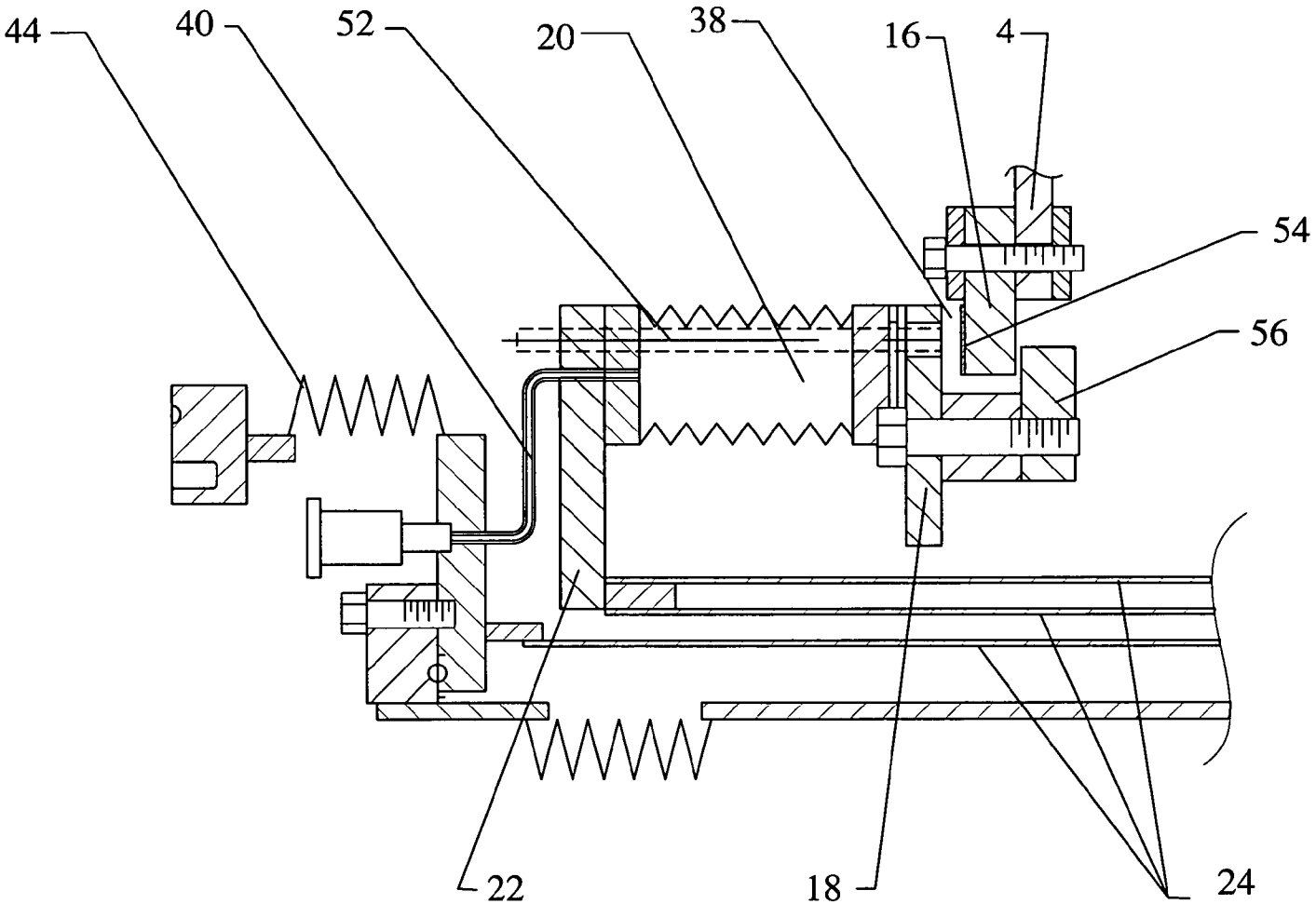
FIG. 2 shows a schematic of a pneumatic actuator.
Figure 3:
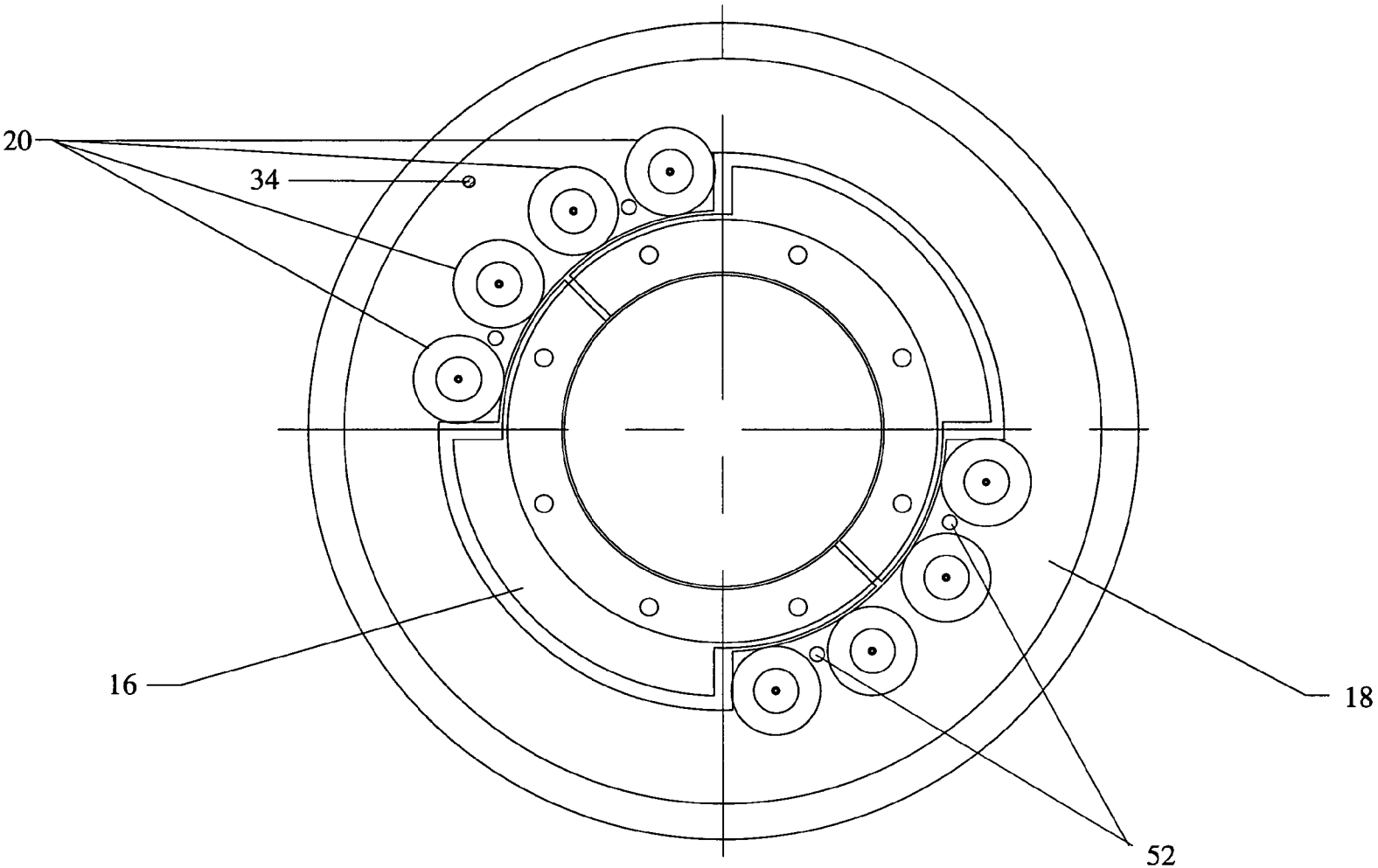
FIG. 3 shows a cross section view of a coupler between the cryocooler first stage and the intermediate temperature station, showing a mating wing and flange arrangement for installation and removal of the cryocooler (in a disengaged position)

An actuator includes a deformable element 20 (for instance bellows) that is filled with gas that does not liquefy or solidify at the operating temperature (for instance helium) through pneumatic actuator pressurization tube 40 (see FIG. 2). When the actuator is not pressurized, it assumes an uncoupled position, which corresponds to the stages of the cooling device being uncoupled mechanically and thermally from the intermediate and cold temperature stations, and thus, the object to be cooled. When the actuator is powered to expand, by being pressurized, the bellows expands, and equal and opposite forces are applied to intermediate temperature station 18 and to pneumatic actuator support 22.

Retracting actuator 34 is shown as a linear motion actuator, which can be displaced in the same direction as the main axis C of the cryocooler. It has access to the cryocooler space vacuum through flexible retracting actuator bellows 58, which permits axial displacement of the retracting actuator 34 for cryocooler disengagement without breaking vacuum. The retraction limiter 52 is immobile, and contacts the cryocooler first stage wing 16 during retraction of the cryocooler, to provide the force necessary to open the gap 38 in the intermediate temperature thermal path and gap 36 in the cold path.

A pneumatic bellows 20 is attached at one end to the pneumatic actuator support 22 with another end facing the intermediate temperature station 18 (see FIG. 2). The retracting limiter 52 is placed between actuator bellows and under the wings of the pneumatic actuator support 22 and intermediate temperature station 18.

A purpose of an invention hereof is to provide means for attaching a cryocooler with two stages to an intermediate temperature station and a cold station of a cooled object in such a manner as to enable quick connect and disconnect, without applying any forces to the object to be cooled due to the thermal coupling or uncoupling with the cooling device. This operation is required for cryocooler head replacement, both for regular maintenance as well as for unscheduled maintenance, without the need to break the cooled object vacuum or to warm up the thermal radiation shield, current leads and cooled object. The cooled object can be a superconducting magnet, a detector, a motor or other cooled device, while the intermediate thermal station can be thermally connected to current leads, and/or to a thermal radiation shield, and/or to mechanical supports of the cooled object to minimize a heat load of the cooled object.

As an example, not to be taken as limiting, of a useful embodiment, the intermediate temperature is between 25 and 90 K, while the cooled object can be from 2 K all the way to 30 K. For applications with low temperature superconducting magnets the intermediate temperature can be around 40-70 K, while the temperature of the cooled object (superconducting magnet) is from 3 K to 12 K.

An engagement sequence is described next (see FIGS. 1A and 1B). First the retracting actuator 34 is reset to allow engagement by the pneumatic actuator bellows 20. After the cryocooler is placed so that the cryocooler first stage wings 16 go through the slots in pneumatic actuator support 22 and intermediate temperature station 18, the cryocooler is rotated until the wings 16 of the cryocooler first stage are placed directly between the intermediate temperature station 18 and the retractor ring 56. The vacuum flange 46 of the cryocooler head 2 is sealed to seal the cryocooler vacuum (bounded as described above). The space of the cryocooler vacuum is pumped out.

The actuator is, at this moment, in an uncoupled position. Engagement is then carried out by increasing the pressure of the helium gas in the pneumatic actuator bellows 20 by feeding gas through pneumatic actuator pressurization tube 42, and the pneumatic actuator bellows 20 extends to a coupling position, exerting a force to intermediate temperature station 18 and an equal and opposite force to the pneumatic actuator support 22. The intermediate temperature station moves (due to a flexible connection 26 with flange 14), closing the gap 38 in the intermediate temperature path. The force on the intermediate station 18 is transmitted to the wings 16 attached to the first stage 4 of the cryocooler and through its rigid body to the cold, second stage 6, pushing it toward the cold station 30 (to the right, as shown), and closing the gap 36. The balancing force (toward the left, as shown) on the pneumatic actuator support 22 is transmitted through the rigidly connected intermediate-to-room temperature support tube 24, intermediate temperature flange 14, cold-to-intermediate support tube 12 and cold station 30. Once the gaps 36 and 38 close, the cryocooler 4, 6 stages are pinched between the intermediate temperature station 18 and the cold station 30, with the pressures at the interfaces which were formerly the gaps 36 and 38, increasing as pressure in the actuator 20 increases.

Once the actuator is in the coupling position and the gaps are closed, the actuator continues to apply increasing forces on the contacting elements, which increasing forces are reacted along the cryocooler cold head 6, cryocooler body between two stages, and first stage head 4, establishing good thermal coupling in thermal pathways.

No force is transferred or applied to the cold object (and its radiation shield) when the cryocooler is compressed against the thermal stations of the cold object and its radiation shield. This condition can be achieved if the heat transferring surfaces 16* of the first and 6* of the second stages of the cryocooler, face in opposite directions. This is facilitated by the first stage 4 of the cryocooler having wings 16, which penetrate through respective openings in the intermediate temperature station 18.

During initial installation and during replacements when the cold object has been allowed to warm up, the cryocooler is turned on after engaging the intermediate temperature thermal path and the cold thermal path and energizing the actuator.

In the case of the cold object remaining at cold temperatures, there are at least two options for starting up the cryocooler. One method has the cryocooler turned on and allowed to partially cool before activating (pressurizing) the pneumatic actuator bellows 20 and connecting the cryocooler to the intermediate temperature and the cold temperature thermal paths. Alternatively, in another method the pneumatic actuator bellows 20 is activated, establishing contact between the warm cryocooler and the colder intermediate temperature station 18 and cold station 30. After the gaps are closed and the intermediate temperature and cold thermal circuits are reestablished, the cryocooler is turned on.

The same but opposite directed forces act on the surface of the cold station 30 and the surface of the intermediate temperature station 18, across which the cold thermal path and intermediate temperature thermal path are established. The contact areas at the intermediate temperature station 18 and cold station 30 are selected so that appropriate contact pressures are applied at both stages for adequate thermal transfer. A pliable material, for instance, an indium gasket 54 in FIG. 2 at the intermediate temperature thermal path, and indium gasket 48 (see FIGS. 4A and 4B) at the cold temperature thermal path, are placed between mating surfaces in both the intermediate temperature and the cold thermal paths to maximize thermal conductance in a vacuum.

The contact pressure across the intermediate temperature and cold thermal circuits demountable joints can be adjusted by varying the pressure of the gas in the pneumatic actuator 20. A beneficial gas in the bellows is helium. Pneumatic actuators offer a significant advantage over some other actuators, such as a mechanical spring actuator, because a pneumatic actuator can provide precise pressure, and thereby pressure control in the thermal coupling, even over a very wide range of temperature variation during the entire time of the cryocooler operation.

One of the ends of the intermediate-to-room temperature support tube 24 is at room temperature, on the side of the room temperature flange 23 and the other end is in contact with the intermediate temperature flange 14. Similarly, the cold-to-intermediate temperature support tube 12 is in contact with the intermediate temperature flange 14 at one end and with the cold station 30 at the other. To prevent excessive heat loads, the tubes are made of thin steel, sufficiently thick to support the loads, but thin enough to maintain low thermal conductance between the ends. To increase the length of the warm-cold thermal passes along tubes and reduce heat transfer along the tubes, they can be made as a reentrant assembly of multiple tubes welded to stainless steel spacer rings 11, 13, 21 and 25, as shown in the figures.

When pneumatic actuator 20 is pressurized the cryocooler body between the first stage 4 and the second stage 6 is in compression. Structural issues of the cryocooler may limit the forces applied by the pneumatic actuator 20. If so, a reinforcing crossbar can be installed between the first and the second stage flanges of the cryocooler. The reinforcing crossbar may be made of a material with low thermal conductivity, for instance a fiber-glass material. Another constraint is the pressure limitations of the bellows of the pneumatic actuator 20.

Simply removing the pressure on the gas of the pneumatic actuator bellows 20 is not enough to disengage the intermediate temperature and cold stations. Substantial forces need to be applied to break the mechanical adhesion at the coupling with indium gaskets. There are multiple means to apply these forces. The figures show, for example, a retraction actuator 34.

A cryocooler disengagement and removal method is described next. If the cold object is a non-persistent superconducting magnet, the magnet is preferentially de-energized during the cryocooler replacement operation. The pneumatic actuator 20 is de-pressurized. Then retraction actuator 34 is used to provide a force to disengage the cryocooler. Two possible outcomes occur next, depending on which gap opens first: the gap 38 in the intermediate thermal path, or gap 36 in the cold path.

If gap 36 in the cold path opens first, the cryocooler second stage 6 moves away from the cold station 30. After some travel away from the cold station 30, the cryocooler first stage wing 16 contacts the retraction limiter 52. Continued application of the retraction actuator 34 results in forces applied to disengage the cryocooler first stage wing 16 from contact with the intermediate temperature station 18. After gap 38 opens in the intermediate temperature thermal path, the cryocooler is no longer thermally or mechanically attached to the system.

If, instead the gap 38 opens first, then further application of the retraction actuator 34 moves the intermediate temperature station 18 away from the cryocooler first stage wing, until eventually retractor ring 56 contacts the cryocooler first stage wing 16. Continued application of the retraction actuator 34 would then disengage the cryocooler second stage 6 from the cold station 30, opening the gap 36 in the cold path. In either case, cryocooler disengagement can be confirmed by the position of the cryocooler head and the retraction actuator 34.

After both gaps 36 in the cold path and 38 in the intermediate temperature thermal path have opened, the cryocooler vacuum space (bounded as described above) is filled with helium gas. The gas (from an external gas source) is introduced in the cryocooler vacuum space (the gas supply line is not shown in the Figures), to prevent condensable gases from accessing the cryocooler vacuum space and condense on cold surfaces. The cryocooler head 2 is disconnected from the vacuum flange 46 by removing bolts connecting the cryocooler head 2 to the vacuum flange 46, while maintaining a steady flow of helium gas to prevent air from entering the cryocooler vacuum space and condensing on cold surfaces. The cryocooler is then rotated so that the cryocooler first stage wings 16 clear the wings in the intermediate station 18. At this point, the cryocooler is clear and can be removed. The vacuum flange 46 is sealed by a temporary cover to prevent air from entering and condensing on cold surfaces.

Replacement of the cryocooler has been described above, for both the cold object at near room temperature (during initial installation or during maintenance where the cold object has been allowed to be warmed up), and for when the cold object remains at low temperature.

To provide good thermal contact in a vacuum between the cold station 30 and the cold thermal anchor 10, they may be soldered together or a thin layer of thermal conducting deformable material may be introduced to the surface before assembly. For instance, a useful material is Apiezon-N grease. The connection between cold station 30 and the cold thermal anchor 10 is established by a set of screws, and is not disconnected during cryocooler retraction and remains cold during the maintenance operation.

The demountable contact between the cryocooler cold head 6 and the thermal station 30 is provided by a thin ductile metal that remains ductile at operating temperatures, such as indium. It is necessary to remove the indium gaskets during cryocooler removal, and thus the indium gasket 48 is adhered to the cryocooler second stage 6. Similarly, the indium gasket 54 is attached to the cryocooler first stage wing 16, and is removed with the cryocooler head. Apiezon-N grease is a material used in all cryogenic non-disconnected thermal couplings to reduce temperature drops in these joints operating in vacuum.

The retraction actuator 34 has no contact with the cold temperature thermal path. The retraction actuator 34 is only in contact with elements at intermediate temperature, and represents a small additional thermal load to the cryocooler first stage.

The bellow actuators 20 present additional heat load to the first stage of the cryocooler due to thermal conductance from relatively warm intermediate-to-room temperature support tube 24 and pneumatic actuator support 22 to the intermediate temperature station 18 and then to the first stage of the cryocooler. This thermal load is limited by thin walls of low thermal conductivity stainless steel bellows as well as thermal insulation disks (for instance of fiberglass composite) bonded to the bottom of the bellow to avoid metal-to-metal contact with the intermediate temperature flange 18. Thermal load to the first stage of the cryocooler due to pneumatic actuator pressurization tube 40 can be limited by using small diameter (2-3 mm) thin wall tube with a very big relative length (length/diameter). Thermal convection from the room temperature region through the pneumatic actuator pressurization tube 40 and inside pneumatic actuator 20 also could present additional heat load for the first stage of the cryocooler. If this thermal load is a problem, the pneumatic actuator pressurization tube 40 can be provided with multiple internal porous plugs (for instance made from compressed stainless steel wires or chips, or high density metallic or ceramic foams) to strongly limit convection heat load due to gas in tubes. Additionally a package of several steel foil disks with thin fiberglass spacers inserted in thermally-insulating tube with diameter close to the bellow inner diameter and attached to the cold bottom of the bellows can minimize convection and radiation thermal load inside the bellows to its cold surface and to the first stage of the cryocooler. The disks and cylinder have very small holes, which permit equal pressure inside the bellows as well as pumping it out.

During cryocooler replacement, the vacuum of the cryocooler is broken by filling the space with flowing helium gas (to avoid condensation and freezing of atmosphere gases and moisture on the cold surfaces), by introducing helium gas deep in the cryocooler vacuum space (precise location not shown in the figures). The presence of helium gas at atmospheric or slightly above its pressure does represent a thermal load to both intermediate temperature and cold thermal circuits, but it is possible to rapidly replace the cryocooler and reestablish the vacuum before much heating of the intermediate temperature and cold thermal paths has occurred.

The cryocooler and coupler can be oriented with the stages of the cryocooler extending generally horizontally, or vertically, or at any orientation in between.

Before engagement, the cryocooler is supported at its head 2, from which the body, including stages 4 and 6 is cantilevered at a horizontal orientation. If it is necessary, alignment supports can be provided to support the cantilevered body against tilting under the force of gravity, or to maintain proper alignment within the cavity. When engaged, the cryocooler is mechanically supported at 30 and partially at 18 by friction forces that arise normal to the compression forces at the interfaces that had formerly been the gaps 36 and 38. At the warm end the weight load of the cryocooler head is taken by flange 46, bellows 44, flange 23, bellows 32, the major cryostat wall 28, and alignment supports. When disengaged, the cryocooler weight is supported only by flange 46 and other parts, see above. The large axial forces required to establish the intermediate temperature and the cold thermal paths are self-contained and balanced within the elements that experience them. Vibrations of the cryocooler in the direction normal to the main axis C of the cryocooler are damped by the presence of flexible bellows 44 and 32. However, axial vibrations are transmitted to the cold station 30. If needed to prevent these vibrations in the cooled object, it is possible to have a section of the cold thermal anchor 10 that is flexible. Vibrations of the elements in the intermediate temperature thermal paths are damped by the flexible thermal anchor 26 and by flex in 8.

An attractive feature of an invention disclosed herein is that no forces are transferred or applied during placement, operation and removal of the cryocooler from the cryocooler to the cold object or to the thermal shield. The forces needed to establish good thermal conduction in both the intermediate temperature thermal path as well as in the cold thermal path are self-contained. Good thermal contact is positively achieved by appropriate selection of the contact areas, and by application of adequate pressure in the pneumatic actuator 20. Good thermal conduction to the cooled object is achieved by using a rigid cold thermal anchor 10.

With or without thermal connection between the cryocooler and cooled object being established, there are no forces applied to the cooled object from the cryocooler. Forces created by the actuator are contained within the structural elements including the cryocooler and its stages 4, 6 and the vacuum walls 24, 12, of the cryocooler vacuum. The cold thermal station is firmly attached to the cold thermal anchor 10 for instance by bolts 35.

In the example shown, the fixture transduces an actuator's linear expansion and the equal and opposite forces generated thereby, to equal and opposite compression forces applied to the cooling device at its intermediate and cold temperature stages. Alternative actuation and fixture designs are possible. What is required is that engagement of the thermal conduction path between the object to be cooled and the cooling object take place without any unbalanced forces applied externally to the object to be cooled. The forces in the thermal coupling are self-contained in the circuit consisting of part of the cooling device between two stages, actuator, and vacuum walls of the cooling device. An alternative design can provide tension forces to the cooling device between intermediate and cold temperature stages. The actuator need not be linear, or pneumatic. It may be rotary, linkages, compressive, etc. It can be electro-mechanical, pneumatic, hydraulic, etc. In general, as the actuator is powered, the cooling device is brought to a coupled position with the cold unit 60, and thus, the object to be cooled. With a linear actuator, it is powered to expand. Other actuators may be powered to rotate elements into a coupled position. A pneumatic actuator, powered by a gas such as helium, does provide the control advantages described above, in a cryogenic context.

The foregoing has described a cryocooler having two stages: a first stage, referred to herein as an intermediate temperature stage, and a second stage, referred to herein sometimes as a cold (lowest temperature) stage. Different cooling devices are used for different applications. The cooling device could be a different kind of cryocooler, such as a pulse tube, Gifford-McMahon, or Sterling type, with one or two stages (one or two temperature levels), cryostats with cryogenic liquid, cryogenic refrigerators (with one, two, or three levels of cooling temperatures) etc. A two-stage cryocooler typically has a united cooling system with two stages (to be connected with the cooled object). It is also possible for there to be more than two stages. For instance, cryogenic refrigerators), could have three stages available for cooling (for instance 78 K, 20 K, 2.0 K). Usually the coldest temperature is used to cool the cooled object and the higher temperatures are used to cool thermal shields (one or two) around the cooled object, current leads, cold mass supports and so on. Such a cooling scheme decreases power required for cooling.

Rather than two stages, there may be only one stage. A single stage set-up is described below, in conjunction with FIGS. 6A and 6B, which show a single stage cooling device and cooled object, with a quick-release thermal coupler in a disengaged configuration shown in FIG. 6A, and an engaged (coupled) configuration shown in FIG. 6B. FIG. 6B only shows a portion of the device shown in FIG. 6A. FIG. 7 shows a cross-section through the device shown in FIG. 6A, at lines 7-7. The object to be cooled and its surrounding cryostat are shown in FIGS. 1A and 1B, not to scale. Generally they are much bigger than the cooling device.

A one stage cooling device 102, of any suitable kind, engages a thermal coupler 119. The coupler, includes an actuator support 122, a fixture 168, a cold station 130 and actuators 120*a, b*, etc., with reference numeral 119 referring to all of these elements together as a coupler, as discussed below. The cooling device cold head 106 is thermally conductively secured (such as by permanent bolts) to a cold head extension 107 with wings made of a thermal conductive material, which may be, for instance of copper. A gap 136 is shown between the cold head extension with wings 107 and the stationary cold station 130. The stationary cold station 130 is thermally conductively coupled to the cold object 137 through a cold anchor 162. The cold anchor 162 and cold object 137 are secured to the cold station 130 by a permanent means such as bolts 135 between a flange 163 and the cold station 130. For a better heat transfer in vacuum they (cold anchor, flange and cold station) can be soldered together, connected with application of indium gasket, or Apiezon N grease.

As with a two stage device discussed above, the two separate elements of cold anchor 162 (with its flange 163) and cold station 130 are secured to each other essentially permanently, and thus may be referred to herein and in the claims as a cold unit 161, or their functions can be served by a unitary element that is also referred to herein as a cold unit.

Figure 6A:
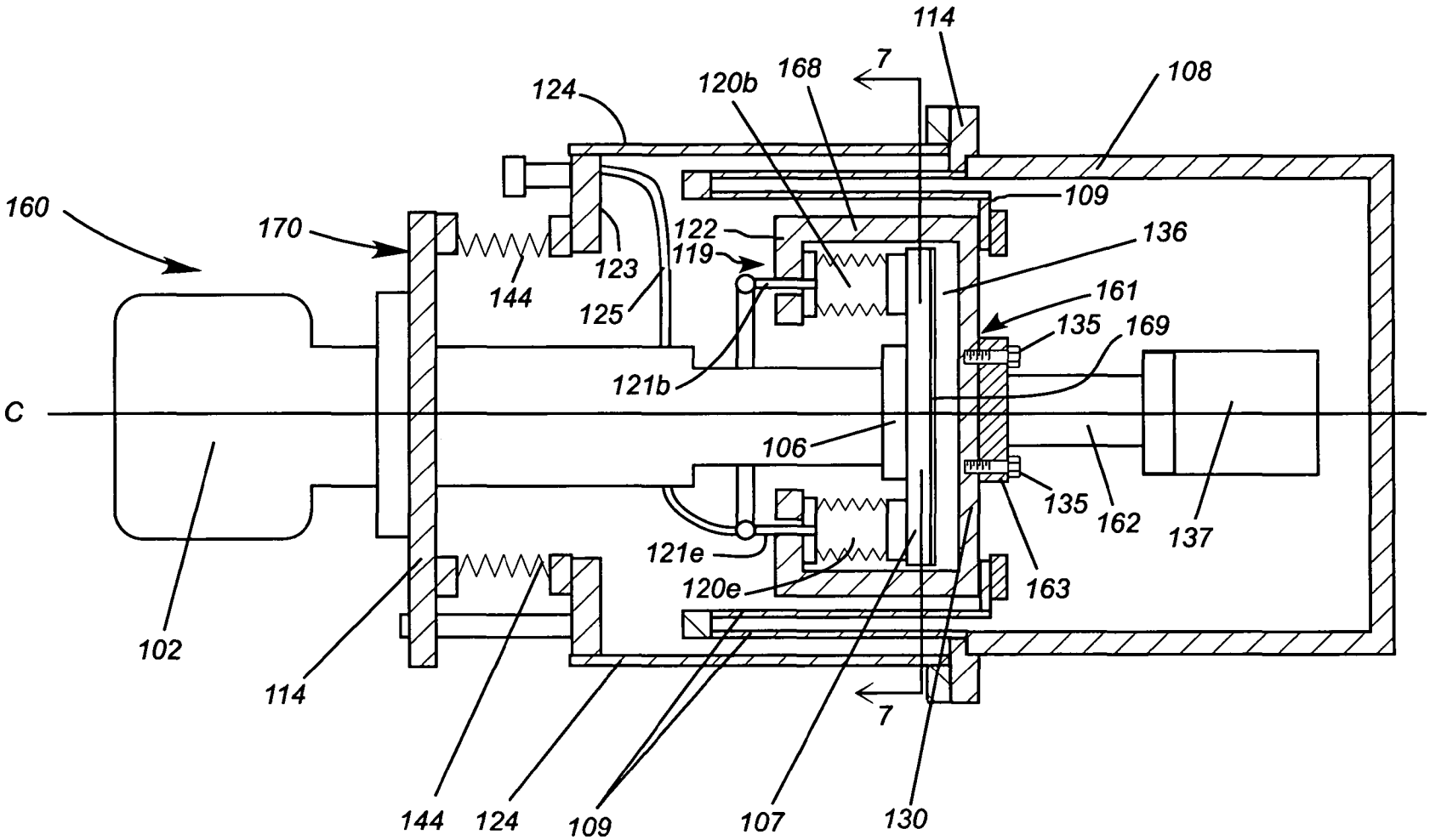
FIG. 6A is a schematic representation in cross-sectional view of a generic cooling device having only one stage, and a coupler and cooled object, shown in a disengaged configuration with gap 136 open.
Figure 6B:
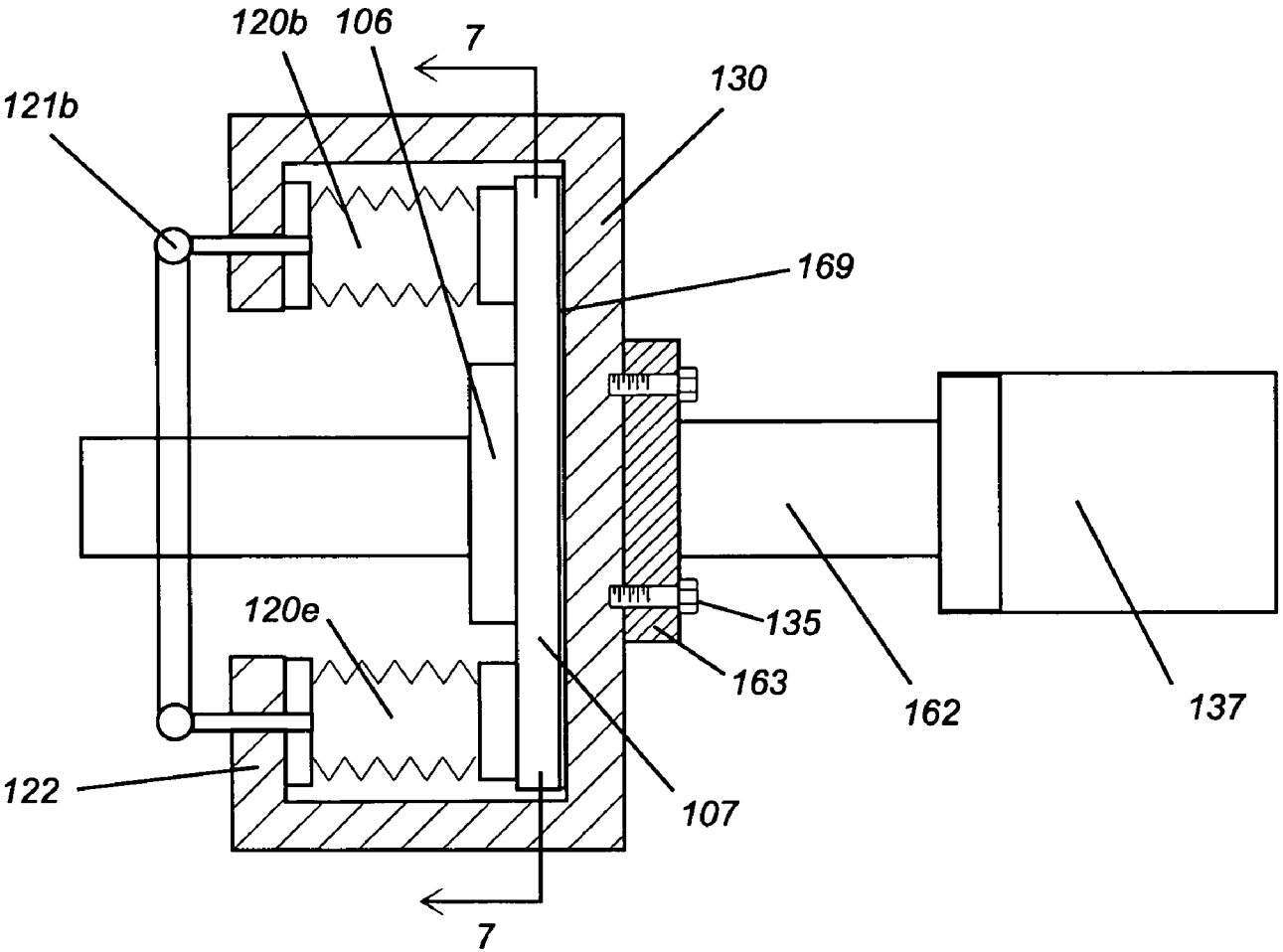
FIG. 6B is a schematic representation of the apparatus shown in FIG. 6A, shown in an engaged configuration.
Figure 7:
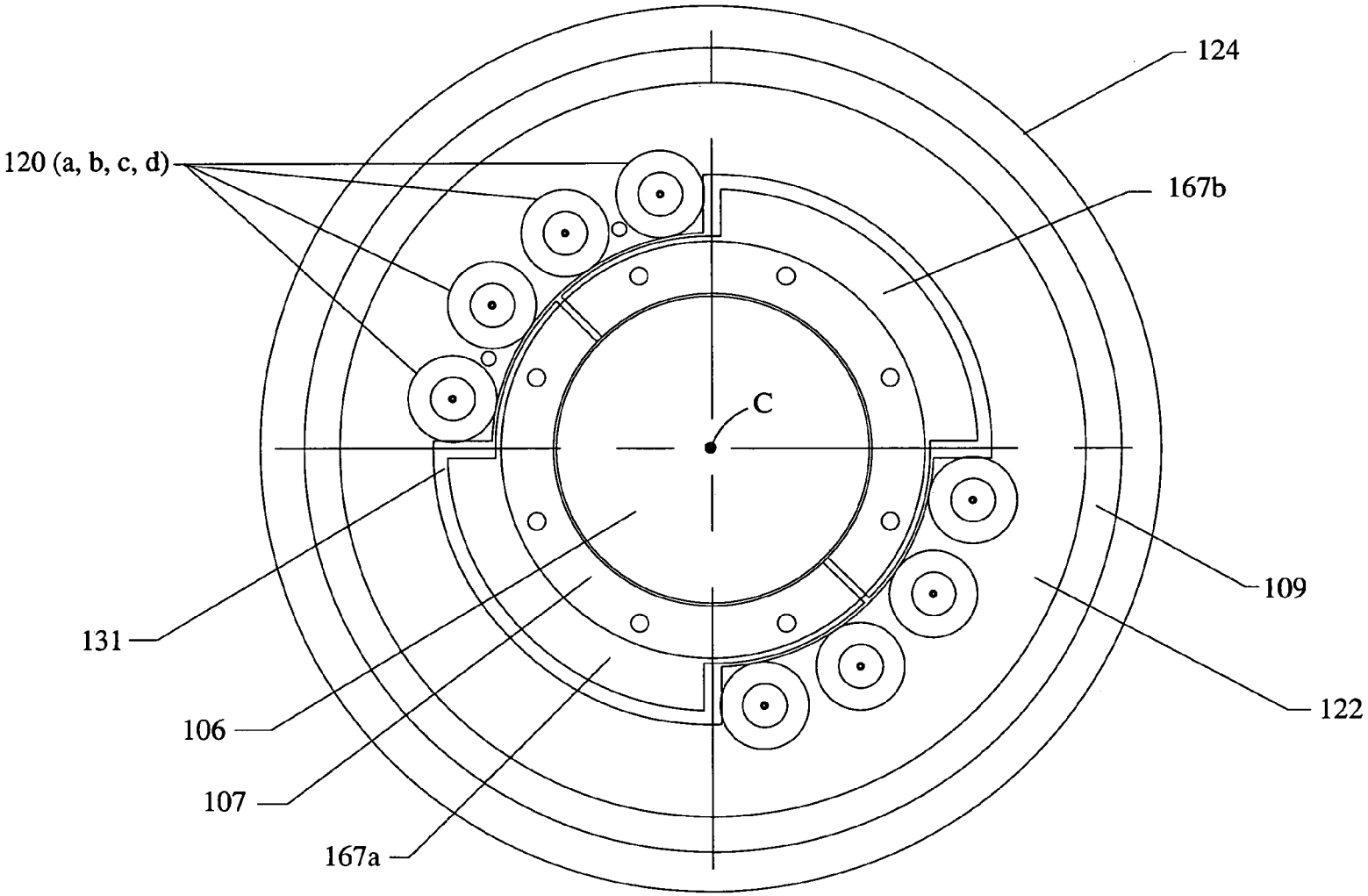
FIG. 7 is a schematic representation of a portion of the apparatus shown in FIG. 6A, in partial end view along the lines 7-7, with the cooling device retracted and rotated from the position shown in FIG. 6A.

An actuator has a plurality of bellows units positioned parallel to longitudinal axis C of the coupler, of which 120*b* and 120*e* are shown in FIGS. 6A and 6B. The actuator support 122 is rigidly coupled to the stationary cold station 130 by the fixture 168. As shown in the cross sectional view in FIG. 7, the embodiment shown has eight such bellows, 120 *a-h*, positioned in two groups of four, all controlled simultaneously by the same pneumatic supply 125 and controller (not shown). The cold head extensions 107 may have wing sections as circumferential ring segments. Two opposing wing sections 167*a* and 167*b*, pass through correspondingly shaped openings in actuator support 122 and permit locking in place, as explained below. There may be two, three, four, or more wing sections, each with a corresponding opening between flange elements. The actuators act upon the wing sections.

A cold object vacuum container 108 surrounds the cold object 137, and is coupled to the stationary cold station 130 by a re-entrant enclosure wall member 109. Another vacuum container 124 partially surrounds the cooling device and is also rigidly coupled to the cold object vacuum container 108 through a ring 114. The cooling device vacuum container 124 is flexibly attached to an end vacuum flange 170 through a flexible wall 144 and a flange 123. The wall member 109 is optionally re-entrant to increase the length of the thermal path between the cold object and the warm surroundings. The wall 144 may be flexible, as shown, to accommodate changes in size, as the various parts change temperature, and also to accommodate the motion of the cooling device as it is inserted and removed.

An engagement sequence for the single stage device is as follows. First the cryocooler is inserted into the coupler. Then the cryocooler is rotated to the position where the wings 107 are opposite bellows 120*b*, 120*e*, etc. Then the flange 114 is sealed and the vacuum space of the cryocooler is pumped out. Next, the actuator bellows 120*a*-120*h* are engaged by expansion of a gas that fills within their chambers, supplied through supply lines 121*e*, 121*b*, which are in turn supplied by a central supply line 125 from an external source of gas, for instance, helium. When pressure is applied to fill the pneumatic chamber of each bellows of the actuator, the chamber expands, forcing the cold head extension wings 107 away from the stationary actuator support 122. The cryocooler with the cold head extension 107 moves toward the cold station 130, closing the gap 136. The actuator fully extends, and presses the cold head extension firmly into the cold station 130 thereby establishing the thermal path from the cold head 106 to the cooled object 137, through the indium gasket 169 bonded to the cold head extension.

No unbalanced external force is applied to the cooled object, because the force necessary to establish the thermal path is established by expanding the bellows 120*b*, 120*e*, etc., with balanced forces upon the actuator support 122 and the cold station 130. An indium gasket may be adhered to the face of the cold head extension 107 facing the cold station 130. The cooled object 137 is thermally connected with the cold station 130 through the cold anchor 162 for instance by bolts 135. No unbalanced force is applied from the coupler to the cooled object, to the cooling device body, and to the vacuum walls of the cooling device or the cooled object. The coupling forces in the thermal coupling are self-contained in the circuit consisting of extension of the cold head of the cooling device, actuator, and actuator support connected with the cold station.

FIG. 6B shows the coupler in a configuration with the gap 136 closed, and the cold head extension pressing firmly against the cooling device surface of the cold station through the indium gasket 169.

FIG. 7, which is an end view of the coupler along the lines 7-7 of FIG. 6A, with the cooling device rotated away from the position shown in FIGS. 6A and 6B, and retracted so that the wings 167*a* and 167*b* are at the same level as the actuator ends, helps to illustrate how the cooling device is inserted and removed from the coupler. As described above, in general, partially circumferential flanges on each of the cooling device and portions of the coupler are shaped and sized to allow passing the cooling device through an opening in the coupler when the cooling device is in a first rotational orientation relative to the coupler, and to prevent such insertion (and removal) and passing when the cooling device is not in the first rotational orientation.

For instance, the cold head extension 107 may have a pair of wings 167*a* and 167*b* that are oppositely positioned across the central axis C of the cooling device, which wings are sized to fit within correspondingly shaped openings in the circumferential extent of the actuator support 122. To insert the cooling device, the wings 167*a* and 167*b* are lined up with the respective openings, and the cooling device is inserted along the axis C. After the cold head extension has passed through the opening 131, it is rotated 90° around the C axis, so that the wings become aligned with the bellows 120 *a*-*h*, and is thereby locked against removal. It can translate a small distance, within the space between the bellows 120 *a*-*h* and the, of the cold station 130.

Rather than wings and mating openings, other mechanical schemes for relatively quick disengagement and re-engagement can be used. Such examples include, but are not limited to: bayonet-type pin and slot; various sorts of a clutch, e.g. roughly analogous to an automotive disk brake, expandable cylindrical sections that engage a surrounding wall, radially extendable arms, or other members.

FIGS. 6A, 6B and 7 do not show any actuator for disengaging the cold head 106 from the cold object 107, analogous to the retraction actuator handle and rod 34 of the two stage coupler shown in FIG. 1A. Any suitable means can be used to retract the cooling device, such as by gripping and pulling on the head 102. In this case the tensile forces are transferred to the cooling device body. The tensile forces have less potential for damage than compressive forces, which pose the risk of possible buckling. But, in any case, no forces are transferred to the cooled object. Also an retracting actuator rod (not shown) can be used, pulling the cold head extension 107 to the left (as shown). In this case practically no forces are transferred to the cooling device either.

The cooled object has its own separate vacuum space bordered by cold object vacuum container 108, shared reentrant wall 109, and the cold thermal station 130. The cooling device has its own vacuum space bordered by the cold station 130 also, shared re-entrant wall 109, cooling device vacuum container 124, flange 123, flexible bellows wall 144, and end flange 170. Breaking the vacuum of the cooling device doesn't have any influence on the cooled object vacuum. The cooling device can be replaced without breaking the cooled object vacuum.

As with the two-stage embodiment discussed above, the fixture and actuator arrangement need not be as shown. What is required is that the fixture and actuator provide engagement of the thermal conduction path between the object to be cooled and the cooling object without any unbalanced forces applied externally to the object to be cooled, to the cooling device body, and to the vacuum walls of the cooling device or the cooled object.

For a one stage embodiment of the type shown in FIG. 6A, another beneficial effect is that the cooling device itself need not be compressed or experience any external, unbalanced force, in the same manner as the cooled object remains free of such forces in both embodiments. As shown, the cold stage wing extensions 107 are bolted to the cold stage 106, in the same manner as the cold anchor 162 is bolted (or otherwise attached) to the cold station 130. Thus, upon engagement and further pressure to establish the thermal path, the cooling device is not compressed. The only force upon it is at the flange that is bolted or secured in some other way to the wings 107. But the force within this joint is contained within the elements of the joint, and does not vary as the engagement pressure increases.

A further benefit of such a one stage device, as shown, is that no forces arise in the walls of either of the vacuum enclosures, 108 of the cooled object or 124 of the cooling device.

In a two stage embodiment, the actuators are shown acting directly on the first, warmer stage of the cooling device. However, this need not be the case. The actuators could alternatively have been placed acting directly upon the colder second stage of the cooling device, for instance if fitted with wings analogous to wings 107 in the one stage embodiment (in which case, the cooling device body could be under tension between two stages) or, upon both stages. Such a design, with the actuator acting directly at both stages, permits that no compressive forces transfer to the cooling device body.

While particular embodiments have been shown and described, it will be understood by those skilled in the art that various changes and modifications may be made without departing from the disclosure in its broader aspects. It is intended that all matter contained in the above description and shown in the accompanying drawings shall be interpreted as illustrative and not in a limiting sense.

The cooled object could be a superconducting magnet, cryogenic magnet (made of non-superconducting wires, with a very low electrical resistance at cryogenic temperatures), infrared detectors (for instance for a night vision and temperature measurements), space instruments (bolometers) for measurements of earth temperature, different electronic devices, cryo-medical and cryo-surgical instrumentation and equipment, etc. Important features, common with all of these devices, are: separate vacuum thermal insulation for both source of cooling and cooled object; and the ability to disconnect the source of cooling and replace it without breaking the insulating vacuum of the cooled object (and not to warm it up).

SUMMARY

An important apparatus embodiment of an invention hereof is a coupler for thermally coupling a cooling device having at least one cooling stage, to an object to be cooled. The coupler comprises: a cold station configured to couple with a cold stage of a cooling device and configured to connect with an object to be cooled. Mechanically rigidly connected to the cold station, is an actuator support, between which and the cold station, the cold stage of the cooling device fits, movably. A coupling actuator is arranged to apply substantially equal and opposite forces to the cold stage and the actuator support, thereby forcing the cold stage from an uncoupled configuration into a coupled configuration, with the cold stage contacting the cold station, without any force being applied to the object to be cooled. The apparatus also comprises a cooling device vacuum enclosure, shaped and sized to house a cooling device vacuum around the cooling device, comprising the cold station; and a cooled object vacuum enclosure, shaped and sized to house an object to be cooled, also comprising the cold station, arranged to house a cooled object vacuum that is hydraulically independent from the cooling device vacuum.

In a related important embodiment the cold stage contacts the cold station without any force being applied to the cooling device. It may also be that the cold stage contacts the cold station without any force being applied to the cooling device vacuum enclosure. A related important embodiment has the cold stage contact the cold station without any force being applied to the cooled object vacuum enclosure. It may also be that the cold stage contacts the cold station without any force being applied to any of: the cooling device the cooling device vacuum enclosure, or the cooled object vacuum enclosure.

With all of the related inventions hereof, it is advantageous for the cold station to be configured to connect fixedly with an object to be cooled.

For any invention disclosed herein, it is useful that an indium gasket be thermally coupled to the cold stage.

With a very important embodiment, the actuator comprises a pneumatic actuator. The actuator may comprise a plurality of pneumatic actuators, arranged to operate in parallel, which actuators may be bellows. The pneumatic actuator is beneficially a helium powered actuator.

In general, it is useful that the actuator support comprise a surface arranged substantially facing and opposite the cold station. In such a case, the actuator comprises a linearly extendible member, coupled to the actuator support surface and pushing the cold stage of the cooling device, toward the cold station, upon energization.

An additional important related embodiment, further comprises a releasable couple that releasably couples the cold stage with the coupler. The cold stage may, in such a case, comprise a device circumferential flange. The releasable couple comprises a coupler circumferential flange, connected to the cold station, with the device flange and the coupler flange being shaped and arranged so that: with the cooling device in a first rotational position, translation of the cold stage relative to the coupler is limited to a range of inserted positions; and with the cooling device in a second rotational position, translation of the cold stage relative to the coupler is free to move beyond the range of inserted positions. The releasable couple may alternately comprise a clutch.

For still another related embodiment of an apparatus invention hereof further the cooling device comprises a cryocooler.

With yet another important embodiment the object to be cooled comprises a magnet.

An embodiment of an apparatus invention hereof further comprises: an object to be cooled; and an apparatus coupled functionally to the object to be cooled. With such an embodiment, the object to be cooled may advantageously comprise a magnet and, further, the apparatus coupled functionally to the object to be cooled may comprise a magnetic resonance imaging apparatus.

A related embodiment of an apparatus invention hereof further comprises a cooling device, which may be a cryocooler.

With each of the apparatus embodiments of inventions hereof, there may be a retraction actuator, coupled to the cold stage, which retraction actuator is a different actuator from the coupling actuator, the retraction being actuator arranged to move the cold stage from the coupled position to an uncoupled position.

A related important embodiment of an apparatus invention hereof is a coupler for thermally coupling, a cooling device to an object to be cooled, where the cooling device is a type having at least a first and a second, colder, cooling stages, which stages are rigidly coupled to each other. The coupler comprises: an intermediate temperature station, configured to couple releasably with the first stage of the cooling device; a cold station, configured to fixedly connect to the object to be cooled and also to couple releasably with the second, colder stage of the cooling device; and a fixture that rigidly connects the cold station to an actuator support. This embodiment also includes an actuator that couples the actuator support to the intermediate temperature station, the actuator and fixture being configured such that energization of the actuator causes the intermediate temperature station to move away from the actuator support, and also brings into contact: i. the intermediate temperature station with the first stage, of the cooling device; and the cooling device colder stage with the cold station. Forces are thereby established on the first stage and the colder stage, which forces are substantially equal and opposite to each other, without any force being applied to the cold object. This embodiment also comprises a cooling device vacuum enclosure shaped and sized to house a cooling device vacuum around the cooling device, comprising the cold station; and a cooled object vacuum enclosure, shaped and sized to house an object to be cooled, the cooled object vacuum enclosure being hydraulically independent of the cooling device vacuum enclosure, such that a vacuum within the cooling device vacuum enclosure can be broken without breaking a vacuum within the cooled object vacuum enclosure.

More specifically, the cooling device may comprise a body with the first stage at a first location between a first and a second end of the body, and the colder stage being located at the second end of the body. The fixture then comprises an enclosure into which the cooling device fits, the enclosure comprising a rigid wall that is fixed to the actuator support and extends therefrom, toward and beyond the intermediate temperature station and further toward the cold station, extending beyond the colder stage of the cooling device when the cooling device is inserted within the fixture. The associated actuator comprises a linearly extendable actuator which, upon energization: forces a movable end of the actuator in the direction toward the cold station and away from the actuator support until the movable end of the actuator meets the intermediate temperature station; and further forces the intermediate temperature station to move in the direction of the colder stage of the cooling device to cause contact between the intermediate temperature station and the first stage of the cooling device, also forcing the first stage, and the entire cooling device, including the second colder stage, in the direction of the colder stage of the cooling device, such that pressure increases at an interface joining the colder stage and the cold station as well as at an interface joining the intermediate temperature station and the first stage of the cooling device, without any force being applied to the object to be cooled.

Regarding an important variation of an apparatus invention hereof, the actuator has an uncoupled position, and the coupler is configured such that with the actuator in the uncoupled position, the intermediate temperature station and the first stage are mechanically and thermally uncoupled and the cold station and the colder stage are mechanically and thermally uncoupled. With such a device the actuator has a range of motion, and the coupler is configured such that with the actuator in a coupled position, the intermediate temperature station and the first stage of the cooling device are mechanically and thermally coupled. The coupler of such an apparatus may further be configured such that with the actuator in a coupled position, the cold station and the colder stage of the cooling device are mechanically and thermally coupled. According to one variation the coupler can be configured such that with the actuator in the coupled position, as the actuator is powered to expand, pressure and thermal coupling between the cold station and the colder stage of the cooling device increases, without any force being applied to the object to be cooled.

As with the embodiments described above for a single stage cooling device, with the two or more stages, the actuator may comprising a pneumatic actuator, either single or a plurality, which plurality may be arranged in parallel. The actuators may be powered by helium gas supply.

An advantageous embodiment has the actuator support member comprising a surface arranged substantially facing the cold station, the actuator comprising a linearly extendible member, coupled to the actuator support surface and the cold stage of the cooling device, to push the cooling device away from the actuator support when the actuator is energized, toward the colder end of the cooling device.

Such a coupler may further comprise a couple that releasably couples the cooling device with the coupler. In such a case, the cooling device may comprise a device flange, and the intermediate temperature station may comprise a flange element. The device flange and the intermediate temperature station flange element are shaped and arranged so that: with the cooling device in a first rotational position, translation of the first stage relative to the coupler is limited to a range of inserted positions; and with the cooling device in a second rotational position, the first stage is free to translate relative to the coupler beyond the range of inserted positions. A convenient configuration to achieve this has the intermediate temperature station flange element comprising openings, the actuator support comprising openings, and the cooling device first stage comprising wings, which fit within the openings of the intermediate temperature station flange element and of the actuator support.

As with the one stage cooler embodiment, for a two or more stage embodiment, the cooling device may comprise a cryocooler and the object to be cooled may comprise a magnet. The apparatus coupled functionally to the object to be cooled may comprise a magnetic resonance imaging apparatus or a proton beam radiation treatment apparatus. The cooling device can further be part of the coupler. Finally, there can be a retraction actuator, coupled to the first stage, which retraction actuator is a different actuator from the coupling actuator, the retraction actuator being arranged to move the first stage from a coupled position to an uncoupled position.

The engagement actuator can be applied to directly push the intermediate station toward the intermediate stage of the cooling device as shown, or it can be applied to directly push the cold stage of the cooling device toward and into contact with the cold station, or the actuator can be connected to directly contact both the intermediate and cold stages of the cooling device. Or, there can be two such actuators, one for each stage.

Important aspects of inventions disclosed herein are also methods, of which an important embodiment is a method to thermally couple a cooling device having at least one cooling stage to an object to be cooled. The method comprises the steps of: providing a thermal coupler comprising: a cold station connected with the object to be cooled and configured to couple, with a cold stage of the cooling device; mechanically rigidly connected to the cold station, an actuator support, between which and the cold station, the cold stage fits, movably. Connected to the cold stage, at least one wing extension is configured to fit through at least one corresponding opening in the actuator support; an engagement actuator is arranged to apply substantially equal and opposite forces to the at least one wing extension of the cold stage and the actuator support, upon energization, thereby forcing the cold stage from an uncoupled position, toward and into a coupled position, contacting the cold station, without any force being applied to the object to be cooled. Also part of the coupler is a cooling device vacuum enclosure shaped and sized to house a cooling device vacuum, around the cooling device, comprising the cold station; and a cooled object vacuum enclosure, shaped and sized to house an object to be cooled, arranged to house a cooled object vacuum that is hydraulically independent from the cooling device vacuum. The method also includes the steps of introducing the cooling device into the cooling device vacuum enclosure, such that the at least one wing extension passes through the corresponding opening in the actuator support, and positioning the cold stage of the cooling device in an uncoupled position between the actuator support and the cold station; and rotating the cooling device so that the at least one wing extension is opposite the actuator. The final step of the general description of this method is energizing the actuator, so that it engages the wing extension, thereby forcing the cold stage from an uncoupled position, toward a coupled position, contacting the cold station, without any force being applied to the object to be cooled.

As with the apparatus embodiments discussed above, the method embodiments of the inventions hereof can be accomplished with many of the apparatus discussed above. For instance, the actuator may comprise a pneumatic actuator, and the step of energizing the actuator may comprise increasing the pressure of a gas provided to the actuator. The gas may be helium. The actuator may be sole, or a plurality, which plurality may operate in parallel.

The method may further comprise the step of establishing a vacuum within the cooling device vacuum enclosure, followed by activating the cooling device. Activating the cooling device may take place either before or after energizing the actuator.

A final step in the method of coupling may be decoupling, accomplished by providing a retraction actuator, coupled to the cold stage, which retraction actuator is a different actuator from the coupling actuator, with the method to couple further comprising the step of energizing the retraction actuator to move the cold stage from the coupled position to an uncoupled position.

A very important embodiment of an invention hereof is a method to thermally couple a cooling device having a first and a second, colder, cooling stages, to an object to be cooled. The cooling device stages are rigidly connected to each other. The method comprises the steps of: providing a thermal coupler generally of a type described above, for instance comprising: an intermediate temperature station, configured to couple releasably with the first stage of the cooling device; a cold station, configured to fixedly connect to the object to be cooled and also to couple releasably with the second, colder stage of the cooling device; and a fixture that rigidly connects the cold station to an actuator support. Connected to the first stage, at least one wing extension is configured to fit through at least one corresponding opening in the intermediate temperature station. An actuator couples the actuator support to the intermediate temperature station. The actuator and fixture are configured such that energization of the actuator moves the intermediate temperature station, away from the actuator support and also brings into contact: the intermediate temperature station with the first stage of the cooling device; and the cooling device colder stage with the cold station. Forces are thereby established on the first stage and the colder stage, which forces are substantially equal and opposite to each other, without any force being applied to the object to be cooled. The device that is provided also comprises: a cooling device vacuum enclosure shaped and sized to house a cooling device vacuum that surrounds the cooling device, comprising the cold station; and a cooled object vacuum enclosure, shaped and sized to house an object to be cooled, the cooled object vacuum enclosure being hydraulically independent of the cooling device vacuum enclosure, such that a vacuum within the cooling device vacuum enclosure can be broken without breaking a vacuum within the cooled object vacuum enclosure. The method of coupling also includes the steps of: introducing the cooling device into the cooling device vacuum enclosure such that the at least one wing extension passes through the corresponding opening in the actuator support; positioning the first stage of the cooling device in an uncoupled position by rotating the cooling device so that the at least one wing extension is opposite the intermediate temperature station; and energizing the actuator, so that contact arises between: the intermediate temperature station with the first stage of the cooling device; and the cooling device colder stage with the cold station.

For an important embodiment, the actuator comprises a pneumatic actuator, and the step of energizing the actuator comprises increasing the pressure of a gas provided to the actuator.

The method to couple the two stage embodiment may further comprise the step of establishing a vacuum within the cooling device vacuum enclosure followed by activating the cooling device. Activating the cooling device may take place before or after energizing the actuator.

Helium gas may be introduced into the cooling device vacuum enclosure.

As with a one stage configuration, there may also be provided a retraction actuator, coupled to the cooling device, which retraction actuator is a different actuator from the coupling actuator, and the method to couple may further comprise the step of energizing the retraction actuator to move the cold stage from the coupled position to an uncoupled position.

Many techniques and aspects of the inventions have been described herein. The person skilled in the art will understand that many of these techniques can be used with other disclosed techniques, even if they have not been specifically described in use together. For instance, for a two or more stage cooling device, the coupling actuator can be coupled directly to the intermediate temperature station or to the cold stage, or both. The retraction actuator can similarly be coupled directly to either or both stages. The specific arrangement of an actuator support and a fixture that rigidly connects the support to the cold station may take a different geometric path or shape, as long as it permits applying a balancing force to the cold station that is equal and opposite to the force that is applied at the cold station by the cold stage, so that no unbalanced force remains to affect the cold object. The type of fixture shown may be used with a wing and opening flange type quick-connect mechanism, or a clutch, or any other releasable coupling mechanism. The actuator need not be linearly expanding, but can be rotary, or some other configuration.

This disclosure describes and discloses more than one invention. The inventions are set forth in the claims of this and related documents, not only as filed, but also as developed during prosecution of any patent application based on this disclosure. The inventors intend to claim all of the various inventions to the limits permitted by the prior art, as it is subsequently determined to be. No feature described herein is essential to each invention disclosed herein. Thus, the inventors intend that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

What is claimed is:

1. A coupler for thermally coupling, to an object to be cooled, a cooling device having at least a first and a second, colder, cooling stages, which stages are rigidly coupled to each other, the coupler comprising:

a. an intermediate temperature station, configured to couple releasably with the first stage of the cooling device;

b. a cold station, configured to fixedly connect to the object to be cooled and also to couple releasably with the second, colder stage of the cooling device;

c. a fixture that rigidly connects the cold station to an actuator support;

d. a linearly extendable actuator that couples the actuator support to the intermediate temperature station, the actuator and fixture configured such that energization of the actuator forces a movable end of the actuator in the direction toward the cold station and away from the actuator support until the movable end of the actuator meets the intermediate temperature station, which causes the intermediate temperature station to move away from the actuator support in the direction of the colder stage of the cooling device, also forcing the first stage, and the entire cooling device, including the second colder stage, in the direction of the colder stage of the cooling device, and also brings into contact:

i. the intermediate temperature station with the first stage, of the cooling device; and ii. the cooling device colder stage with the cold station such that pressure increases at an interface joining the colder stage and the cold station as well as at an interface joining the intermediate temperature station and the first stage of the cooling device;

thereby establishing a force on the first stage and the actuator support, which forces are substantially equal and opposite to each other, without any force being applied to the object to be cooled;

e. a cooling device vacuum enclosure shaped and sized to house a cooling device vacuum around the cooling device, comprising the cold station; and f. a cooled object vacuum enclosure, shaped and sized to house an object to be cooled, the cooled object vacuum enclosure being hydraulically independent of the cooling device vacuum enclosure, such that a vacuum within the cooling device vacuum enclosure can be broken without breaking a vacuum within the cooled object vacuum enclosure.

2. The coupler of claim 1, the cooling device comprising a body with the first stage at a first location between a first and a second end of the body, and the colder stage being located at the second end of the body;

the fixture comprising an enclosure comprising a rigid wall that is fixed to the actuator support and extends therefrom, toward and beyond the intermediate temperature station and further toward the cold station, extending beyond the colder stage of the cooling device when the cooling device is inserted within the fixture.

3. The coupler of claim 1, the actuator having an uncoupled position, the coupler configured such that with the actuator in the uncoupled position, the intermediate temperature station and the first stage are mechanically and thermally uncoupled and the cold station and the colder stage are mechanically and thermally uncoupled.

4. The coupler of claim 3, the actuator having a range of motion, the coupler configured such that with the actuator in a coupled position, the intermediate temperature station and the first stage of the cooling device are mechanically and thermally coupled.

5. The coupler of claim 4, the coupler configured such that with the actuator in a coupled position, the cold station and the colder stage of the cooling device are mechanically and thermally coupled.

6. The coupler of claim 4, the coupler configured such that with the actuator in the coupled position, as the actuator is powered to expand, pressure between the cold station and the colder stage of the cooling device increases, without any force being applied to the object to be cooled.

7. The coupler of claim 4, the coupler configured such that with the actuator in the coupled position, as the actuator is powered to expand, thermal coupling between the cold station and the cold stage increases, without any force being applied to the object to be cooled.

8. The coupler of claim 1, the actuator comprising a pneumatic actuator.

9. The coupler of claim 8, the pneumatic actuator comprising a plurality of pneumatic actuators, arranged to operate in parallel.

10. The coupler of claim 1, the actuator support member comprising a surface arranged substantially facing the cold station, the actuator comprising a linearly extendible member, coupled to the actuator support surface and the cold stage of the cooling device, to push the cooling device away from the actuator support when the actuator is energized, toward the colder end of the cooling device.

11. The coupler of claim 1, further comprising a couple that releasably couples the cooling device with the coupler.

12. The coupler of claim 11, the cooling device comprising a device flange, the intermediate temperature station comprising a flange element, the device flange and the intermediate temperature station flange element being shaped and arranged so that:

a. with the cooling device in a first rotational position, translation of the first stage relative to the coupler is limited to a range of inserted positions; and b. with the cooling device in a second rotational position, the first stage is free to translate relative to the coupler beyond the range of inserted positions.

13. The coupler of claim 12, the intermediate temperature station flange element comprising openings, the actuator support comprising openings, and the cooling device first stage comprising wings, which fit within the openings of the intermediate temperature station flange element and of the actuator support.

14. The coupler of claim 1, the cooling device comprising a cryocooler.

15. The coupler of claim 1, the object to be cooled comprising a magnet.

16. The coupler of claim 8, the pneumatic actuator comprising a helium gas activated actuator.

17. The coupler of claim 1, further comprising:

a. an object to be cooled; and b. an apparatus coupled functionally to said object to be cooled.

18. The coupler of claim 17, the object to be cooled comprising a magnet.

19. The coupler of claim 17, the apparatus coupled functionally to the object to be cooled comprising a magnetic resonance imaging apparatus.

20. The coupler of claim 17, the apparatus coupled functionally to the object to be cooled comprising a proton beam radiation treatment apparatus.

21. The coupler of claim 1, further comprising a cooling device.

22. The coupler of claim 21, the cooling device comprising a cryocooler.

23. The coupler of claim 1, further comprising a retraction actuator, coupled to the first stage, which retraction actuator is a different actuator from the coupling actuator, the retraction actuator arranged to move the first stage from a coupled position to an uncoupled position.

24. A method to thermally couple to an object to be cooled, a cooling device having a first and a second, colder, cooling stage, which stages are rigidly connected to each other, the method comprising the steps of:

a. providing a thermal coupler comprising:

i. an intermediate temperature station, configured to couple releasably with the first stage of the cooling device;

ii. a cold station configured to fixedly connect to the object to be cooled and also to couple releasably with the second, colder stage of the cooling device;

iii. a fixture that rigidly connects the cold station to an actuator support;

iv. connected to the first stage, at least one wing extension configured to fit through at least one corresponding opening in the intermediate temperature station;

v. a linearly extendable actuator that couples the actuator support to the intermediate temperature station, the actuator and fixture configured such that energization of the actuator forces a movable end of the actuator in the direction toward the cold station and away from the actuator support until the movable end of the actuator meets the intermediate temperature station, which causes the intermediate temperature station, to move away from the actuator support in the direction of the colder stage of the cooling device, also forcing the first stage, and the entire cooling device, including the second colder stage, in the direction of the colder stage of the cooling device, and also brings into contact:

A. the intermediate temperature station with the first stage of the cooling device; and B. the cooling device colder stage with the cold station such that pressure increases at an interface joining the colder stage and the cold station as well as at an interface joining the intermediate temperature station and the first stage of the cooling device; thereby establishing a force on the first stage and the actuator support, which forces are substantially equal and opposite to each other, without any force being applied to the object to be cooled;

vi. a cooling device vacuum enclosure shaped and sized to house a cooling device vacuum that surrounds the cooling device, comprising the cold station; and vii. a cooled object vacuum enclosure, shaped and sized to house an object to be cooled, the cooled object vacuum enclosure being hydraulically independent of the cooling device vacuum enclosure, such that a vacuum within the cooling device vacuum enclosure can be broken without breaking a vacuum within the cooled object vacuum enclosure;

b. introducing the cooling device into the cooling device vacuum enclosure such that the at least one wing extension passes through the corresponding opening in the actuator support;

c. positioning the first stage of the cooling device in an uncoupled position by rotating the cooling device so that the at least one wing extension is opposite the intermediate temperature station; and d. energizing the actuator, so that contact arises between:

i. the intermediate temperature station with the first stage of the cooling device; and ii. the cooling device colder stage with the cold station.

25. The method to couple of claim 24, the actuator comprising a pneumatic actuator, the step of energizing the actuator comprising increasing the pressure of a gas provided to the actuator.

26. The method to couple of claim 24, further comprising the step of establishing a vacuum within the cooling device vacuum enclosure.

27. The method to couple of claim 24, further comprising the step of activating the cooling device.

28. The method to couple of claim 27, the step of activating the cooling device taking place before the step of energizing the actuator.

29. The method to couple of claim 27, the step of activating the cooling device taking place after the step of energizing the actuator.

30. The method to couple of claim 24, the step of providing a coupler comprising the step of providing a retraction actuator, coupled to the cooling device, which retraction actuator is a different actuator from the coupling actuator, the method to couple further comprising the step of energizing the retraction actuator to move the cold stage from the coupled position to an uncoupled position.

31. The method to couple of claim 30, further comprising the step of introducing helium gas into the cooling device vacuum enclosure.

* * * * *